US006216354B1

(12) United States Patent
Carbone

(10) Patent No.: US 6,216,354 B1
(45) Date of Patent: Apr. 17, 2001

(54) DEVICE FOR MAKING STRAIGHT AND CURVED SCORE LINES

(76) Inventor: Martin R. Carbone, 1227 De la Vina St., Santa Barbara, CA (US) 93101

( * ) Notice: Subject to any disclaimer, the term of this patent is extended or adjusted under 35 U.S.C. 154(b) by 0 days.

(21) Appl. No.: 09/145,013

(22) Filed: Sep. 1, 1998

(51) Int. Cl.[7] ..... B43L 13/20

(52) U.S. Cl. ..... 33/565; 33/563; 33/566; 33/562; 33/27.01; 83/565

(58) Field of Search ..... 33/566, 565, 562, 33/563, 27.01; 83/565

(56) References Cited

U.S. PATENT DOCUMENTS

| | | | | |
|---|---|---|---|---|
| D. 141,882 | * | 7/1945 | Matson | 33/565 |
| 647,339 | * | 4/1900 | Thompson | 33/563 |
| 2,478,071 | * | 8/1949 | Agrillo | 33/565 |
| 2,552,215 | * | 5/1951 | Rekdahl | 33/565 |
| 4,382,590 | * | 5/1983 | Pandya et al. | 83/565 |
| 4,458,133 | * | 7/1984 | Macken | 83/565 |
| 5,673,490 | * | 10/1997 | Hill | 33/566 |

FOREIGN PATENT DOCUMENTS

| | | | | |
|---|---|---|---|---|
| 2237775 | * | 5/1991 | (GB) | 33/566 |

* cited by examiner

*Primary Examiner*—Diego Gutierrez
*Assistant Examiner*—Yaritza Guadalupe
(74) *Attorney, Agent, or Firm*—Christie, Parker & Hale, LLP

(57) ABSTRACT

A device for forming straight and curved score lines in sheet material. The device has a scoring plate with a top surface with a number of spaced apart curved grooves formed on the top surface thereof. Each of the spaced apart scoring grooves has different radii of curvature. An optional overlay template portion has a number of spaced apart curved slots formed therein. The overlay template portion is adapted to overlay the scoring plate such that the spaced apart curved slots align with the grooves on the scoring plate when placed thereon. A scoring tool with a tip sized to fit into the grooves in the scoring plate and the slots in the optional template overlay portion is provided for scoring the sheet material.

13 Claims, 2 Drawing Sheets

FIG. 1
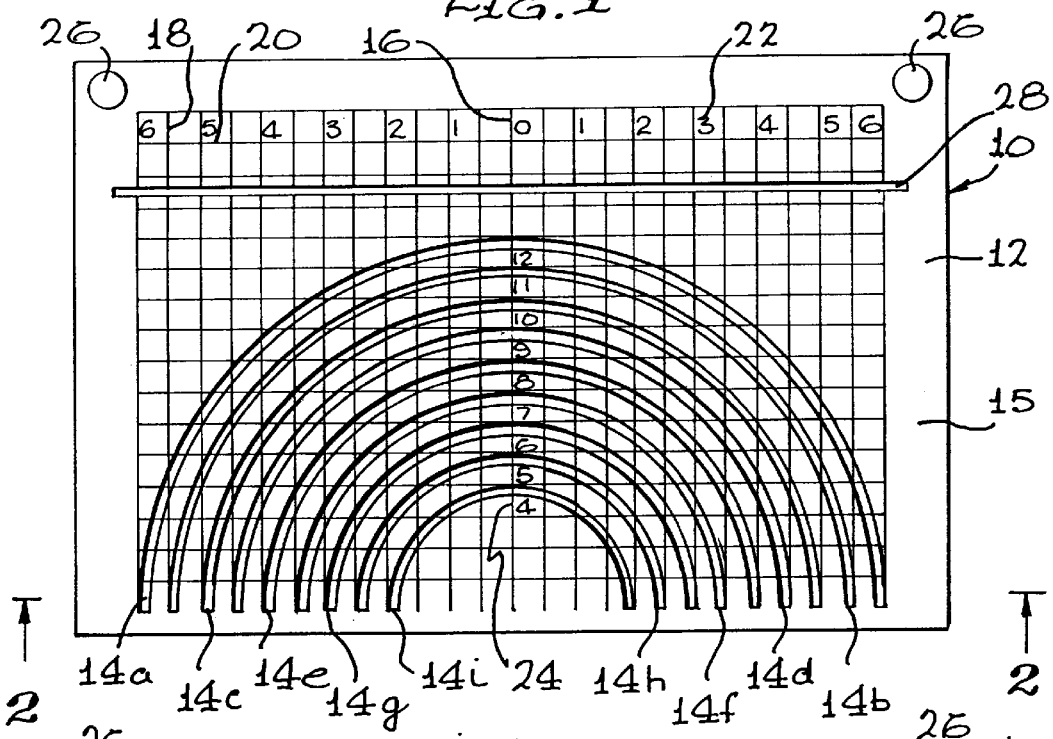
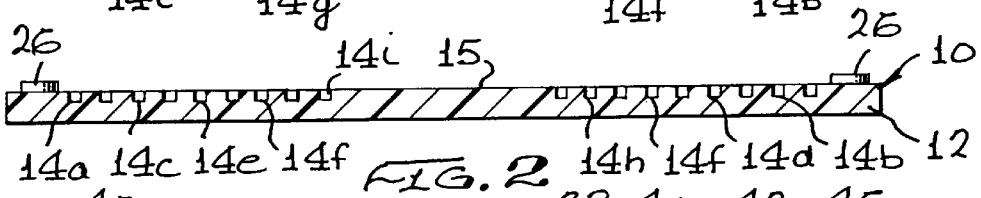
FIG. 2
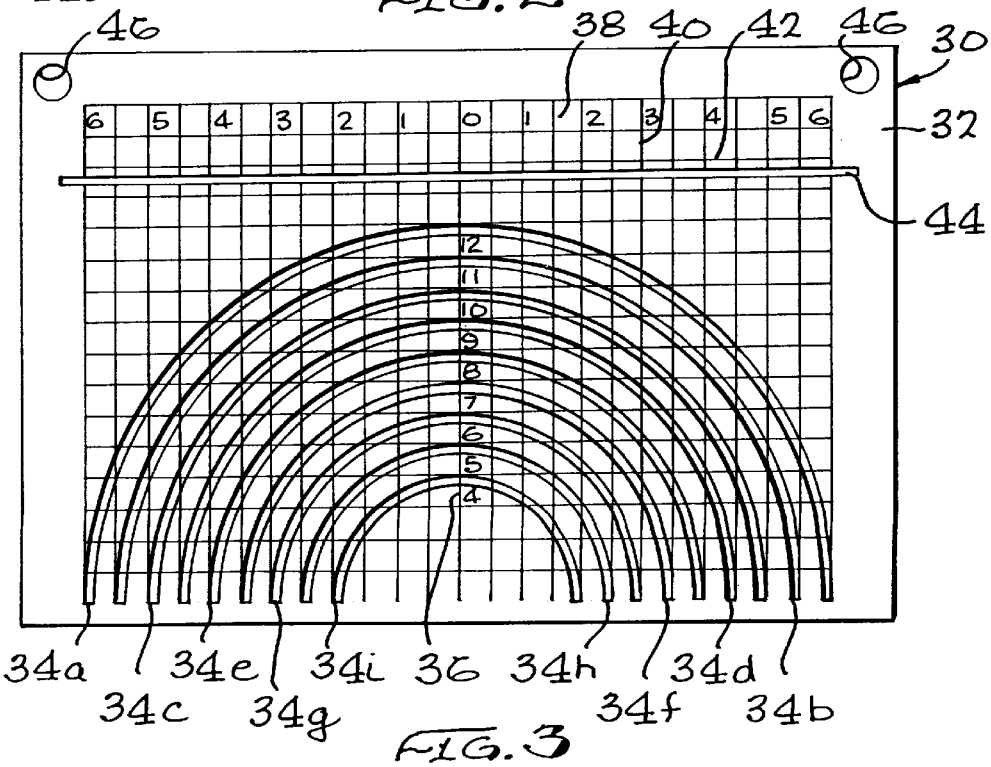
FIG. 3

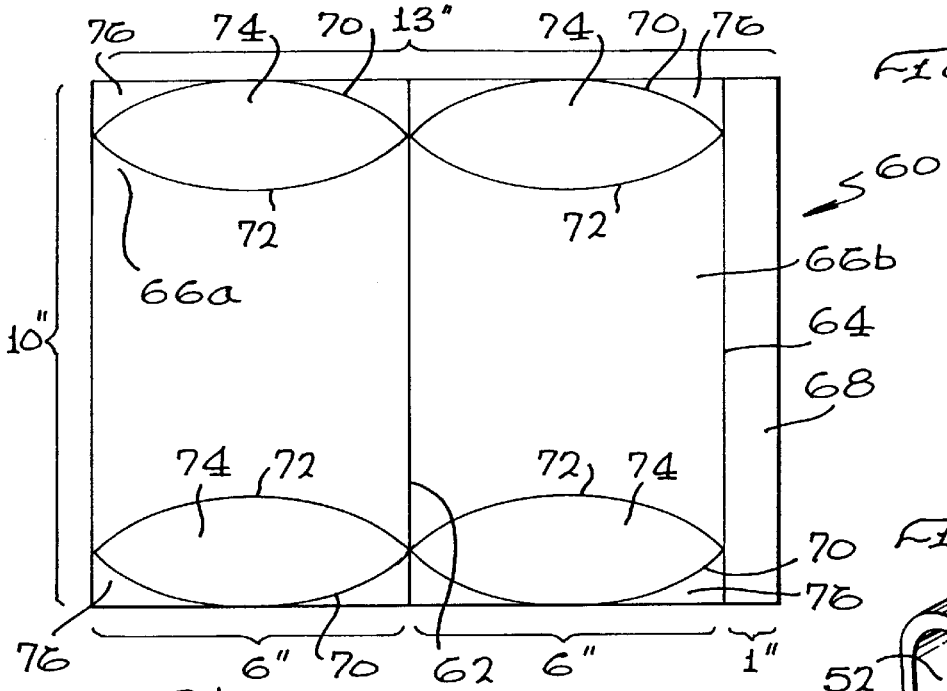
FIG. 5
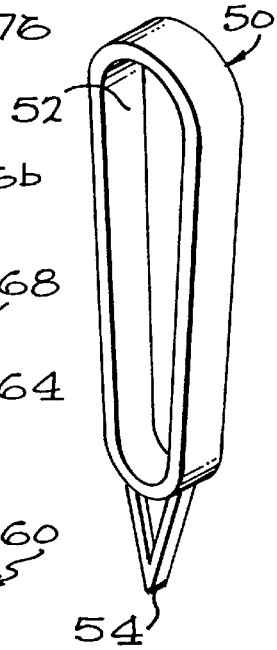
FIG. 4
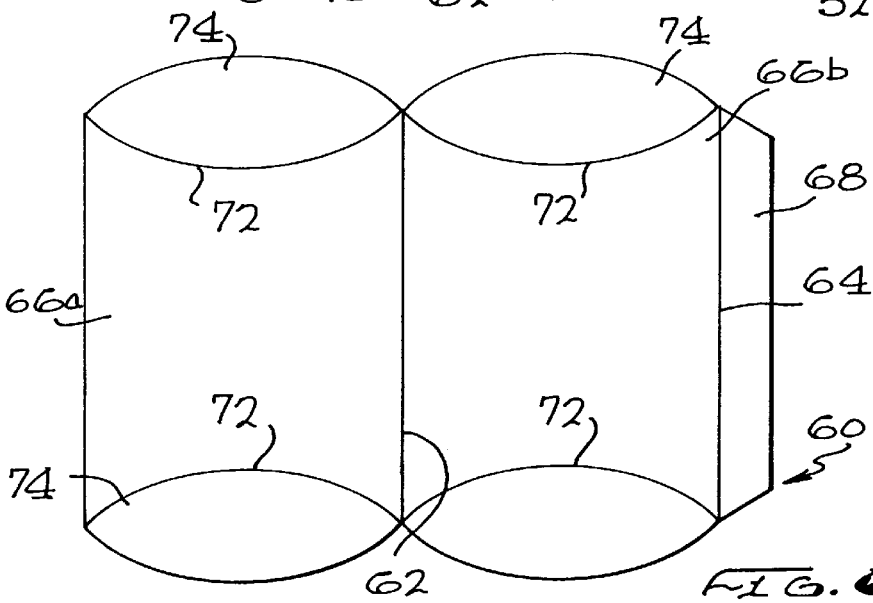
FIG. 6
FIG. 7
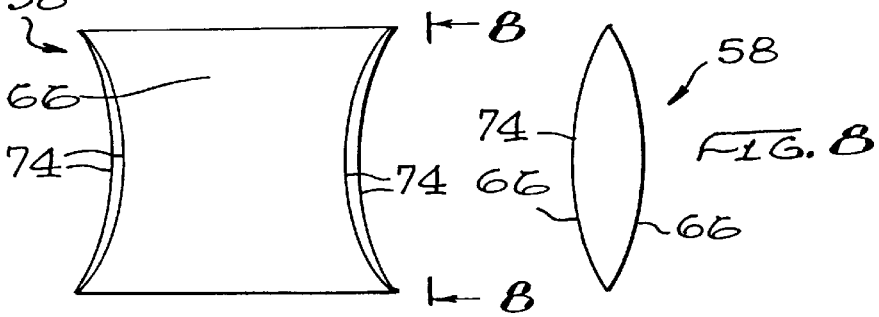
FIG. 8

DEVICE FOR MAKING STRAIGHT AND CURVED SCORE LINES

BACKGROUND OF THE INVENTION

1. Field of the Invention

This invention relates to the field of tools in the area of box making and scoring, and more particularly to a tool for making straight and curved score lines, such as for forming boxes, paper sculptures, toys, and artwork that include curved sides as part of their design.

2. Description of the Prior Art

The inventor herein has obtained U.S. Pat. Nos. 5,484,373 and 5,707,327 and has a pending U.S. patent application No. 08/880,759 all directed to kits and methods of forming straight scoring lines for different type of boxes. The inventor has also filed a U.S. Provisional Patent Application No. 60/058,072 on Aug. 5, 1997 for an invention entitled "Curved Line Scoring Device". The device of this invention comprises a scoring plate with a plurality of grooves formed therein and a scoring tool for use in forcing the sheet material into a scoring groove to form a score line.

People are attracted to new and unique designs. In the area of box and container making, boxes with curved sides offer a refreshing break from the monotony of rectangular solid type boxes. Heretofore, other than the inventor's own invention "Curved Line Scoring Device" noted above, there has been no simple way for the do-it-yourselfer box maker, hobbyist, artist, and others who wished to create curved creases in card stock, cardboard, plastic, and other sheet material to do so. This can be very difficult to do consistently and repeatedly. Accordingly, there remains a need for a device for use in making curved score lines in sheet material.

SUMMARY OF THE INVENTION

One object of the present invention is to provide a device for making score lines, particularly curved score lines, in sheet material such as card stock and plastic sheet material that is easy to use and which helps guide a user in forming perfect curved scoring lines in sheet material.

Another object of the invention is to provide a device for making curved and other shaped score lines in sheet material such as to form pocket boxes.

These and other objects of the invention are set forth below.

BRIEF DESCRIPTION OF THE DRAWINGS

FIG. 1 is a top view of a first embodiment of the scoring plate of the invention.

FIG. 2 is an end view of the scoring plate of FIG. 1 along view lines 2—2.

FIG. 3 is a top view of an optional scoring template overlay portion of the invention.

FIG. 4 is a top view of a scoring tool of the invention.

FIG. 5 is a plan view showing a sheet of cardstock scored to make a pillow box.

FIG. 6 is a plan view showing the scored cardstock of FIG. 5 cut as required.

FIG. 7 is a top view of a pillow box when folded.

FIG. 8 is an end view of the folded pillow box of FIG. 9 along lines 8—8.

FIG. 9 is a cross-sectional view of a sheet of material to be scored placed between the scoring plate and the template overlay portion.

DESCRIPTION OF THE PREFERRED EMBODIMENT

Referring to FIGS. 1 and 2 a first embodiment of the scoring plate 10 of the invention is shown. Scoring plate 10 can comprise a planar base 12 with a plurality of semi-circular grooves 14 a~i formed therein in an upper surface 15 thereof. Grooves 14 a~i are preferably about 0.3175~0.476 mm (⅛" to 3⁄16") wide and about 0.3175~0.476 mm (⅛" to 3⁄16") deep. Dimensioned as such, grooves 14 a~i will function well for scoring paper cardstock having a thickness of about 0.025". For other thickness of material, the depth and width can be adjusted as required. Scoring plate 10 can conveniently be formed of plastic material with grooves 14 a~i formed in upper surface 15 therein. Alternately, wood or other materials can be used. The radii and circumferences of the semi-circular grooves 14*a~i* can be between any size as desired such as between 1" and 16". In the drawings groove 14*a* has a 6" radius, groove 14*b* has a 5½" radius, groove 14*c* has a 5" radius, groove 14*d* has a 4½" radius, 14*e* has a 4" radius, groove 14*f* has a 3½" radius, groove 14*g* has a 3" radius, groove 14*h* has a 2½" radius, and groove 14*i* has a 2" radius. The center of each semi-circle is on a common line 16. A grid pattern of lines 18 and 20 are provided. Lines 20 are tangent to the curves at the common vertical centerline 16 of the curves, and thus are perpendicular to the common vertical centerline 16. Lines 18 are tangent to the curves at points 90 degrees and 180 degrees rotated from the vertical centerline 16, and are parallel to the vertical centerline 16. The plurality of lines 18 and the plurality of lines 20 are at some fixed distance apart from each other, such as ¼" to ½". The lines of grid pattern 18 and 20 further extend on the scoring plate beyond the curves and are used to help orient the card stock being scored correctly on the scoring plate 12 so that the curved scoring line is correctly placed. X axis (vertical) indicator markings 22 and curve diameter indicator markings 24 are formed on scoring plate 12 (such as in inch measurements.) A pair of protrusions 26 are optionally located on scoring plate 12 and extend above upper surface 15 for use with an optional scoring template, as will be discussed below. Protrusions 26 can be cylindrical plugs. For purposes of forming straight score lines as may be required, an elongate straight groove 28 can be formed on scoring plate 12 and can preferably be about 0.3175~0.476 mm (⅛" to 3⁄16") wide and about 0.3175~0.476 mm (⅛" to 3⁄16") deep.

Referring to FIG. 3, a top plan view of a first optional scoring template overlay portion 30 is shown. Scoring template overlay portion 30 is preferably formed of sheet plastic or metal 32 into which a series of slots 34*a~i* are formed. In the case of scoring template overlay portion 30, it is adapted for forming semicircular scoring lines, and thus has a series of semi-circular slots 34*a~i*. For ease of use, the inventor has found that tough, clear plastic, for example, about 0.238~0.3175 mm (3⁄32" to ⅛") in thickness, with slots 34*a~i* being about 0.3175~0.476 mm (⅛" to 3⁄16") wide to accept a scoring tool will function well. Diameter size indicator markings 36 are preferably placed on sheet 32 adjacent to slots 34*a~i*. Likewise, X axis indicator markings 38 can be placed on sheet 32 as well. If desired, a grid pattern of lines 40 and 42 to form squares can be placed on template 32, such as by printed lines and the like. The grid pattern of lines 40 and 42 further extend on the template overlay portion 30 beyond the slots 34*a~i* and are used to help orient the template overlay portion 30 on the card stock being scored. For purposes of forming straight score lines, straight slot portion 44 is preferably formed in template. A pair of apertures 46 are preferably formed in optional scoring template overlay portion 30 and are sized slightly larger than protrusion 26 positioned on scoring plate 26. The purpose of apertures 46 is to allow optional scoring template overlay portion 30 to be aligned such that its semi-circular slots 34*a~i* align with semi-circular grooves 14~*i* in plate portion 10. Used in combination, scoring plate 10 and scoring template overlay portion 30 make forming curved score lines much easier. Although as shown in the figures as semi-circular grooves and slots in scoring plate and overlay template, respectively, the grooves and slots can assume other shapes, such as oval, elliptical, parabolic, or irregular shapes.

Turning to FIG. 4, a view of a scoring tool 50 is shown. Scoring tool 50 has a handle 52 with a scoring tip 54 which is rounded and free from sharp edges to avoid cutting the sheet material to be scored. Scoring tip 54 is sized to be smaller than slots 34*a~i* formed in overlay template 30 and grooves 14*a~i* in scoring plate 10.

A user wishing to form curved score lines in sheet material 60, for example, such as cardstock or plastic material with a thickness of about 0.635 mm (0.025"), will decide what the shape and relative position of the score lines should be. For complex curves, the curve can be transferred with pencil and the like to the surface of the material to be scored, if desired. The sheet material 60 to be scored will then be laid on scoring plate 10 such that the grooves are properly oriented relative to the sheet material 60. As shown in FIG. , the optional scoring template overlay portion 30 may be laid on top of sheet material 60, and with its apertures 46 over protrusions 26, thereby lining up slots 34*a~i* of overlay template 30 with grooves 14*a~i* of scoring plate 10. The user will then take scoring tool 50 and place it in the selected slot (or directly on sheet material if no overlay portion 30 is used), and bear down to score sheet material 60. A scoring line will thus be formed in the desired position on the card stock 60. Depending on the sheet material being used, the scoring pressure necessary will vary. However, by adjusting the pressure applied to the scoring tool, a user can quickly get the feel to make proper score lines. Use of the optional scoring template overlay portion 30 will prevent scoring tool 50 from causing scoring anywhere else other than the desired position, and accurate scoring lines can thus be formed.

Having described the various parts of the device, its use in forming a pillow box 58 is now summarized with respect to FIGS. 5–8. By way of example for use in forming a pocket box with a length of 10" and width of approximately 6" and a depth (or thickness) of 2", with two side cylindrical sections with a 5" radius when viewed along a long axis of the box, the device of the invention can be used as follows.

1. A piece of cardstock 60 is provided in the size of 10" (the length) by 13" (twice the width plus one inch for an overlap seam).
2. The cardstock is scored with score lines parallel to the 10" edge at 6" and 12", 62 and 64, respectively. This essentially defines three panels; those three being the two sides of the box 66*a* and 66*b*—each 10" by 6", and the 1" wide overlapping seam panel 68. This can be accomplished by overlaying the cardstock 60 on scoring plate 10 positioned over elongate slot 28. If desired, the optional template overlay portion 30 can be positioned over scoring plate 10 such that elongate slot 44 is directly over elongate groove 28 and elongate straight score 62 and 64 can be formed as desired.
3. Each of the side panels are scored at each end using the 5" radius semicircular scoring groove 14*c* by laying the cardstock 60 on scoring plate 10, and optionally laying scoring template aligned with scoring slot 34*c* so that the short (6") edge of each panel is tangent to the 5" radius scoring slot 34*c* and directed inwardly into the cardstock 60 in a convex manner, and the long edge is parallel to the scoring lines which are parallel to the centerline of the scoring slots, and the score line 70 is convex toward the end of the panel. Such a score line 70 is formed at the end of each side 66 of the box to be formed.
4. Each side panel 66*a* and 66*b* is now scored at each end using the same scoring slot 34*c*, but lining up the cardstock 60 so the score line 72 is convex toward the center of panels 66*a* and 66*b*. This will yield football-shaped sections 74 at each end of both side panels 66*a* and 66*b*. These areas will become the ends 74 of the pillow box 60.
5. The cardstock areas 76 outside of the football-shaped sections 74 at the end of each side panel 66*a* and 66*b* are cut off with scissors or a craft knife and discarded.
6. The football-shaped sections are folded inwards back and forth along the score lines 72 to soften the material for final folding along these lines later.
7. The 1" by 10" seam panel 68 is flexed back and forth along score line 64 to make score line 64 adjacent to it pliable. It is then folded back toward the inside of the box so it lies flat against the inside of the opposite side panel 66*a*. It is then attached to the inside of the panel 66*a* with glue, adhesive or double-sided tape.
8. The pillow box 58 is essentially complete at this point. All that is required is to fold the four football-shaped sections 74 inwardly where they will lock in place, being held there by tension in the folds 72 and friction between the football-shaped sections 74 and the side panels 66*a* and 66*b*, forming the pillow box 58 as shown in FIGS. 7 and 8.

The combination of the length, width, and thickness of the pillow boxes made as described above are fixed by the length and width of the cardstock being used. The radius of the scoring slot chosen determines the thickness of the box. Larger radii will result in thinner boxes. It is anticipated that the manufacturer of the kit will provide a chart showing the final finished pillow box dimensions using various cardstock sizes and scoring slot radii.

In addition to being used to form pillow boxes, the scoring templates of the invention can be used to make other scored items having curved scoring lines as part of their design, such as toys, models, and artwork of various kinds, just to name a few. The device can also be used to form embossed curved designs on boxes, models and artwork.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the invention being delineated with respect to the following claims.

I claim:

1. A device for forming straight and curved score lines sheet material, comprising:

a scoring plate comprising a plate having a top surface with a plurality of spaced apart curved grooves formed on the top surface thereof, each of the plurality of spaced apart scoring grooves having different radii of curvature, each scoring groove having a width and depth;

an overlay template portion comprising a plurality of spaced apart curved slots formed therein, wherein the overlay template portion is adapted to overlay the scoring plate and the plurality of spaced apart curved slots are aligned with the grooves on the scoring plate when placed thereon; and a scoring tool with a tip, wherein the tip of the scoring tool is sized to be slideably received in a scoring groove.

2. The device of claim 1, further comprising an elongate straight groove formed on the scoring plate.

3. The device of claim 2, further comprising an elongate straight slot formed through the overlay template that is aligned with the elongate straight groove formed on scoring plate.

4. The device of claim 1, where a grid pattern of guide lines is formed on scoring plate for use in helping to properly align sheet material for scoring on the device.

5. The device of claim 1, wherein the plurality of spaced apart curved grooves are semi-circular in shape.

6. The device of claim 1, where a grid pattern of guide lines is formed on overlay template portion for use in helping to properly align sheet material for scoring on the device.

7. The device of claim 1, further comprising means to align the template overlay portion with the scoring plate, such that the slots align with the scoring grooves.

8. The device of claim 7, wherein the means to align the template overlay portion with the scoring plate such that the slots of the overlay template are aligned with the scoring grooves of the scoring plate comprises protrusions formed on the scoring plate with complementary and aligned apertures formed through the template overlay portion.

9. A device for forming straight and curved score lines in sheet material, comprising:

a scoring plate comprising a plate having a top surface with a plurality of spaced apart curved grooves formed on the top surface thereof, each of the plurality of spaced apart scoring grooves having different radii of curvature, each scoring groove having a width and depth;

an overlay template portion comprising a plurality of spaced apart curved slots formed therein, wherein the overlay template portion is adapted to overlay the scoring plate and the plurality of spaced apart curved slots are aligned with the grooves on the scoring plate when placed thereon;

means to align the template overlay portion with the scoring plate, such that the slots align with the scoring grooves; and a scoring tool with a tip, wherein the tip of the scoring tool is sized to be slideably received in a scoring groove.

10. The device of claim 9, wherein a grid pattern of guide lines is formed on overlay template portion for use in helping to properly align sheet material for scoring on the device.

11. The device of claim 10, wherein a grid pattern of guide lines is formed on scoring plate for use in helping to properly align sheet material for scoring on the device.

12. The device of claim 11, wherein the plurality of spaced apart curved grooves are semi-circular in shape.

13. The device of claim 11, further comprising an elongate straight groove formed in the scoring plate and a slot formed through the overlay template that is aligned with the elongate straight groove formed on scoring plate.

* * * * *